US010790565B2

(12) United States Patent
Gao et al.

(10) Patent No.: US 10,790,565 B2
(45) Date of Patent: Sep. 29, 2020

(54) CAVITY FILTER

(71) Applicant: Samsung Electronics Co., Ltd., Suwon-si, Gyeonggi-do (KR)

(72) Inventors: Fei Gao, Shenzhen (CN); Guangxin Zhao, Shenzhen (CN); Jianwang Wu, Shenzhen (CN); Jinpei Ju, Shenzhen (CN); Lei Cai, Shenzhen (CN)

(73) Assignee: Samsung Electronics Co., Ltd., Suwon-si (KR)

( * ) Notice: Subject to any disclaimer, the term of this patent is extended or adjusted under 35 U.S.C. 154(b) by 122 days.

(21) Appl. No.: 15/749,746

(22) PCT Filed: Aug. 16, 2016

(86) PCT No.: PCT/KR2016/008962
§ 371 (c)(1),
(2) Date: Feb. 1, 2018

(87) PCT Pub. No.: WO2017/030336
PCT Pub. Date: Feb. 23, 2017

(65) Prior Publication Data

US 2018/0226707 A1 Aug. 9, 2018

(30) Foreign Application Priority Data

Aug. 18, 2015 (CN) ..... 2015 1 0506423

(51) Int. Cl.
*H01P 1/205* (2006.01)
*H01P 1/208* (2006.01)
(Continued)

(52) U.S. Cl.
CPC ..... *H01P 1/2053* (2013.01); *H01P 1/205* (2013.01); *H01P 1/207* (2013.01); *H01P 1/208* (2013.01); *H01P 7/06* (2013.01); *H01P 11/008* (2013.01)

(58) Field of Classification Search
CPC .. H01P 1/207; H01P 1/208; H01P 7/06; H01P 1/2053
(Continued)

(56) References Cited

U.S. PATENT DOCUMENTS 8,324,989 B2 12/2012 Hesselbarth
2004/0183627 A1* 9/2004 Lo Hine Tong ..... H01P 1/2088 333/212
(Continued)

FOREIGN PATENT DOCUMENTS

CN 1633730 A 6/2005
CN 103346370 A 10/2013
(Continued)

OTHER PUBLICATIONS

ISA/KR, "International Search Report," International Application No. PCT/KR2016/008962, dated Nov. 22, 2016, 25 pages.
(Continued)

*Primary Examiner* — Rakesh B Patel

(57) ABSTRACT

Provided is a cavity filter that is one of radio frequency filters. The cavity filter includes a printed circuit board (PCB) substrate including a micro band layer, metal layers for grounding, which are arranged on both surfaces of the PCB substrate, having the micro band layer interposed therebetween, a plurality of standard cavity modules which are arranged on the both surfaces of the PCB substrate, in each of which an open side surface is fixed and sealed onto the metal layer, and a plurality of coupling windows, in each of which a part of the metal layer for grounding is removed to expose a part of the PCB substrate.

13 Claims, 8 Drawing Sheets

(51) Int. Cl.
*H01P 7/06* (2006.01)
*H01P 11/00* (2006.01)
*H01P 1/207* (2006.01)

(58) Field of Classification Search
USPC ..... 333/206–209
See application file for complete search history.

(56) References Cited

U.S. PATENT DOCUMENTS

| | | | |
|---|---|---|---|
| 2005/0174749 | A1 | 8/2005 | Liikamaa et al. |
| 2014/0077900 | A1 | 3/2014 | Rogozine et al. |
| 2014/0327499 | A1 | 11/2014 | Park et al. |
| 2017/0077900 | A1 | 3/2017 | Park et al. |
| 2017/0098877 | A1 | 4/2017 | Subedi et al. |
| 2017/0141446 | A1* | 5/2017 | Tkadlec ..... H01P 1/207 |

FOREIGN PATENT DOCUMENTS

| | | | |
|---|---|---|---|
| CN | 104752797 | A | 7/2015 |
| EP | 1732158 | A1 | 12/2006 |
| JP | 2000353903 | A | 12/2000 |
| JP | 2014168178 | A | 9/2014 |
| KR | 10-0976251 | B1 | 8/2010 |
| KR | 10-2011-0041919 | A | 4/2011 |
| KR | 10-2011-0097723 | A | 8/2011 |
| KR | 10-2014-0134260 | A | 11/2014 |
| WO | 2014047820 | A1 | 4/2014 |

OTHER PUBLICATIONS

State Intellectual Property Office of the People's Republic of China, "Notification of the First Office Action," Chinese Application No. CN 201510506423.5, dated Jul. 11, 2017, 14 pages.

Extended European Search Report regarding Application No. 16837278.7, dated Jun. 13, 2018, 9 pages.

Hong et al., "Miniaturization of Substrate Integrated Bandpass Filters", Proceedings of Asia-Pacific Microwave Conference 2010, Dec. 2010, pp. 247-250.

* cited by examiner

CAVITY FILTER

CROSS-REFERENCE TO RELATED APPLICATIONS AND CLAIM OF PRIORITY

The present application claims benefit under 35 U.S.C. § 365 and is a 371 National Stage of International Application No. PCT/KR2016/008962, filed Aug. 16, 2016, which claims priority to Chinese Patent Application No. 201510506423.5, filed on Aug. 18, 2015, the disclosures of which are fully incorporated herein by reference into the present disclosure as if fully set forth herein.

TECHNICAL FIELD

The present disclosure relates to a cavity filter that is one of radio frequency (RF) filters.

BACKGROUND

Cavity filters are widely used in the communication industry. A common cavity filter includes a resonance rod and a cover plate. Firstly, since a cavity of a conventional cavity filter is mostly manufactured as a whole in a die-casting process, not only the high costs of die sinking and machining are incurred but also size and weight may increase.

Conventional cavity filters have many components, which may result in complicated assembly and increased manufacturing costs. In addition, the cover plate is fastened using screws thereby requiring additional structures for connection with a power amplifying board, which lead to loss of intermodulation. Every filter has cavities arranged on only one side. This results in lower space utilization and limited cross coupling.

SUMMARY

An embodiment of the present disclosure provides a cavity filter including a standard cavity module, by which manufacturing costs of the cavity filter are reduced, efficiency of the cavity filter is improved, and easier manufacturing of the cavity filter is facilitated.

A cavity filter according to an embodiment of the present disclosure includes a printed circuit board (PCB) substrate including a micro band layer, metal layers for grounding, which are arranged on both surfaces of the PCB substrate, having the micro band layer interposed therebetween, a plurality of standard cavity modules which are arranged on the both surfaces of the PCB substrate, in each of which an open side surface is fixed and sealed onto the metal layer, and a plurality of coupling windows, in each of which a part of the metal layer for grounding is removed to expose a part of the PCB substrate.

The standard cavity module may be fixed onto the metal layer for grounding by soldering.

The standard cavity module may include a mono-standard cavity module or a dual-standard cavity module.

The mono-standard cavity module may include a cavity body which includes an opening in an end thereof and has a pipe shape extending in a direction, and a protruding column extending from the other end of the cavity body, which faces the opening of the cavity body, and including a screw hole in an end portion thereof.

The dual-standard cavity module may include a cavity body which includes an opening in an end thereof and includes a first body portion and a second body portion which have a pipe shape extending in a direction and are adhered to each other, and a first protruding column and a second protruding column extending from the other ends of the first body portion and the second body portion, which face openings of the first body portion and the second body portion, and including screw holes in end portions thereof.

The dual-standard cavity module may further include a coupling rod arranged on sidewalls between the first cavity module and the second cavity module.

The cavity filter may further include a plurality of coupling through-holes in the PCB substrate, which are used to couple the plurality of standard cavity modules arranged on different surfaces of the PCB substrate.

The cavity filter may further include a plurality of connectors which are fixed onto the PCB substrate and are capacitive-coupled with the plurality of standard cavity modules through the micro band layer.

The cavity filter may further include an adjustment screw nut engaged with the screw hole of the protruding column.

A cavity filter according to an embodiment of the present disclosure includes a metal layer substrate, on both surfaces of which metal layers are arranged, a plurality of standard cavity modules which are arranged on the both surfaces of the metal layer substrate, in each of which an open side surface is fixed onto the metal layer for sealing, and a plurality of coupling through-holes in the metal layer substrate, which are used to couple the plurality of standard cavity modules arranged on different surfaces of the metal layer substrate.

The standard cavity module may be fixed onto the metal layer for grounding by soldering.

The metal layer substrate may include the metal layer electroplated on both surfaces of a ceramic substrate or may include the metal layer.

The standard cavity module may include a mono-standard cavity module or a dual-standard cavity module.

The mono-standard cavity module may include a cavity body which includes an opening in an end thereof and has a pipe shape extending in a direction, and a protruding column that extends from the other end of the cavity body, which faces the opening of the cavity body, and includes a screw hole in an end portion thereof.

The dual-standard cavity module may include a cavity body, which includes an opening in an end thereof and includes a first body portion and a second body portion that have a pipe shape extending in a direction and are adhered to each other, and a first protruding column and a second protruding column extending from the other ends of the first body portion and the second body portion, which face openings of the first body portion and the second body portion, and including screw holes in end portions thereof.

The dual-standard cavity module may further include a coupling rod arranged on sidewalls between the first cavity module and the second cavity module.

The cavity filter may further include an impedance matching line passing through the metal layer substrate, in which the impedance matching line couples a plurality of standard cavity modules arranged on the same surface of the metal layer substrate.

The cavity filter may further include a tap piece arranged inside the standard cavity module and a plurality of connectors connected with the tap piece.

The cavity filter may further include an adjustment screw nut engaged with the screw hole of the protruding column.

With the cavity filter according to an embodiment of the present disclosure, by fixing the standard cavity module onto the substrate by soldering, complex die-casting for the cavity module may be avoided, thus enabling size and weight reduction of a device.

Moreover, since the standard cavity modules are soldered, an additional component for fixing the standard cavity module is not needed, thereby achieving cost reduction. If a standard cavity module is fixed onto a substrate using soldering in a cavity implemented as a standard module, it is possible to prevent a gap between the cavity and the substrate, which may be generated during fixing of the cavity onto the substrate using bolt engagement. The standard cavity module may be made smaller in size and have more excellent electroplating effect than a die-casting cavity. A material used for the standard cavity module is not limited to a material used for die-casting module, thus allowing use of various materials.

In an embodiment using a printed circuit board (PCB) substrate, coupling of standard cavity modules may be achieved using wire arrangement, thereby more easily designing the cavity filter regardless of cavity topology arrangement. Since the standard cavity modules may be arranged on both surfaces of the substrate, the space utilization rate of the cavity filter may be increased.

DETAILED DESCRIPTION

Embodiments of the present disclosure will be described in detail with reference to the accompanying drawings where the embodiments are illustrated.

Figure 1A:
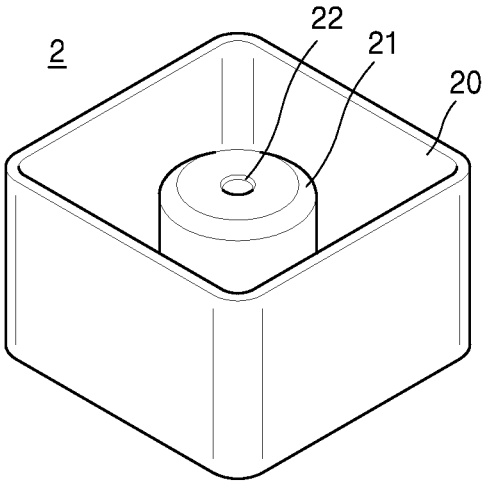
FIGS. 1A and 1B are perspective views of a standard cavity module according to an embodiment of the present disclosure.
Figure 1B:
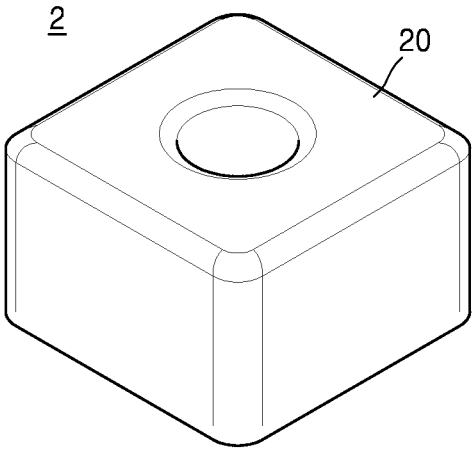
Figure 1C:
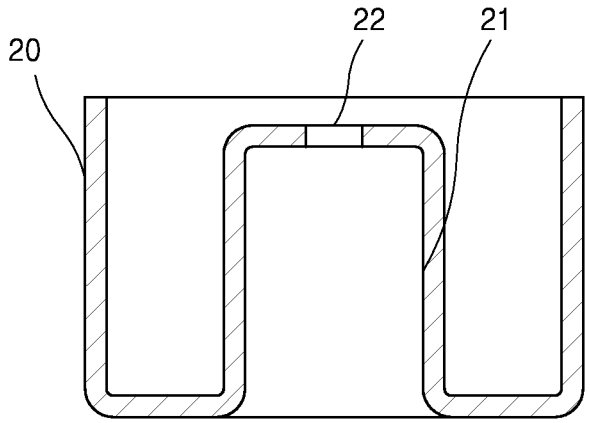
FIG. 1C is a cross-sectional view of a standard cavity module shown in FIG. 1A.

FIGS. 1A and 1B are perspective views of a standard cavity module according to an embodiment of the present disclosure. FIG. 1C is a cross-sectional view of the standard cavity module shown in FIG. 1A. A standard cavity module according to the current embodiment may be implemented with a single module.

Referring to FIGS. 1A through 1C, a standard cavity module 2 according to an embodiment of the present disclosure may include a cavity body 20 including an opening at an end portion thereof, a protruding column 21 extending from the other end portion facing the end portion, and a screw hole 22 in the center of an end portion of the protruding column 21. In an embodiment, the cavity body 20 may be implemented in a rectangular parallelepiped or cylinder shape. In this case, a cavity resonance space is provided inside the cavity body 20, and the protruding column 21 extends to the cavity resonance space.

For example, the standard cavity module 2 may be formed using sheet metal stamping or metal powder metallurgy. The standard cavity module 2 may include copper, iron, aluminum, an alloy, etc. If sheet metal stamping is used, a wall thickness of the cavity body 20 may be reduced and a precision may be improved. Through standard modulization of a resonance cavity, structure designing may be simplified, and costs of simulation modeling and mass production may be reduced.

Figure 2A:
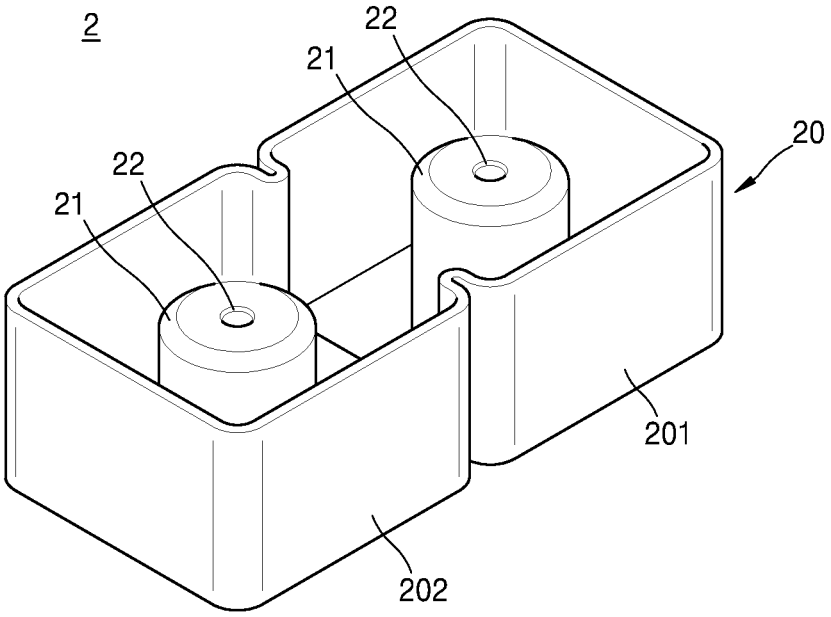
FIGS. 2A and 2B are perspective views of a standard cavity module according to another embodiment of the present disclosure.
Figure 2B:
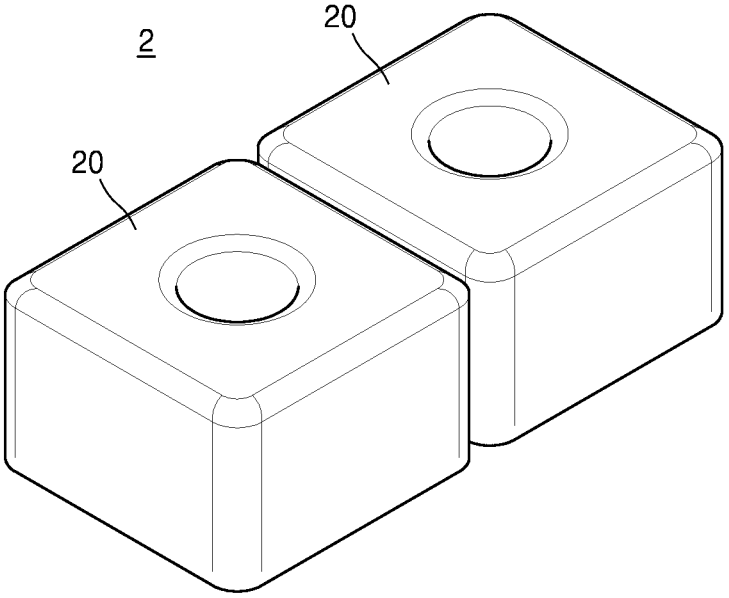
Figure 2C:
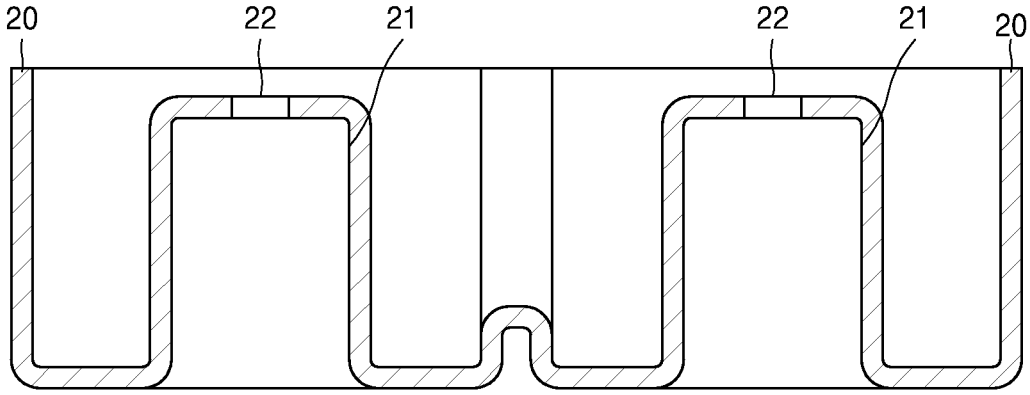
FIG. 2C is a cross-sectional view of a standard cavity module shown in FIG. 2A.

FIGS. 2A and 2B are perspective views of a standard cavity module according to another embodiment of the present disclosure. FIG. 2C is a cross-sectional view of the standard cavity module shown in FIG. 2A. A standard cavity module according to the current embodiment may be implemented as a dual module.

Referring to FIGS. 2A through 2C, the standard cavity module 2 according to an embodiment of the present disclosure may include the cavity body 20 including a first body portion 201 and a second body portion 202, the protruding column 21 arranged in each of the first body portion 201 and the second body portion 202, and the screw hole 22 in the center of an end portion of each protruding column 21. In this case, each of the first body portion 201 and the second body portion 202 may include an opening at an end portion thereof, and each protruding column 21 may extend from the other end portion facing the end portion. In an embodiment, the first body portion 201 and the second body portion 202 may be implemented in a rectangular parallelepiped or cylinder shape, and adjacent sidewalls between the first body portion 201 and the second body portion 202 are removed, such that the first body portion 201 and the second body portion 202 are connected to each other and are coupled through a coupling rod 6 (see FIG. 8). In this case, a cavity resonance space is provided inside the first body portion 201 and the second body portion 202, and the protruding column 21 extends to the cavity resonance space.

To implement cross coupling or tuning coupling of the standard cavity module 2 where standard cavity modules 2 are arranged in parallel, a coupling rod may be arranged in a cavity module integrated in a mono or dual manner. However, the present disclosure is not limited thereto, and in some embodiments based on specific designing and process requirements, the standard cavity module 2 may not be limited to a mono or dual module. For example, if a topology condition is satisfied, a plurality of small cavities arranged in parallel to each other for mass production and cost reduction may be used for multi-cross coupling, and integrally formed multi-cavities may be used.

Figure 3:
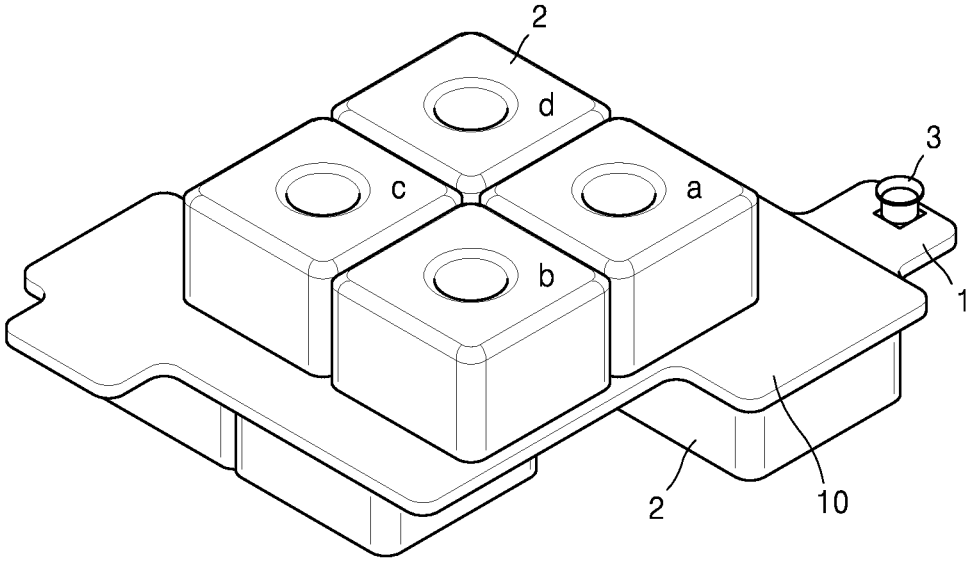
FIG. 3 is a perspective view of a cavity filter according to an embodiment of the present disclosure.
Figure 4:
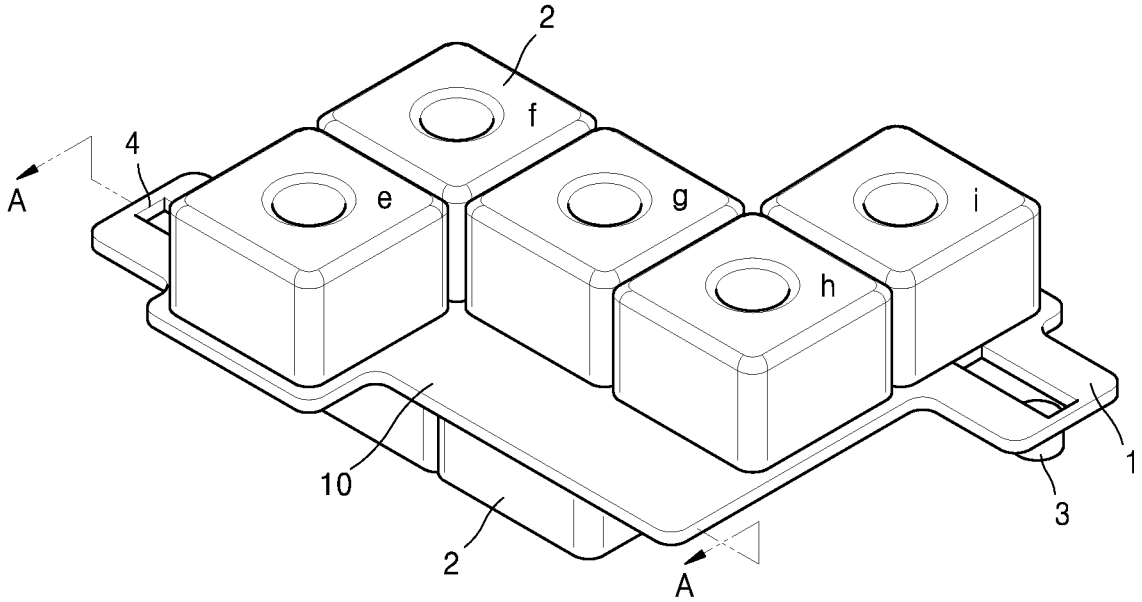
FIG. 4 is a perspective view of a cavity filter according to another embodiment of the present disclosure.
Figure 5:
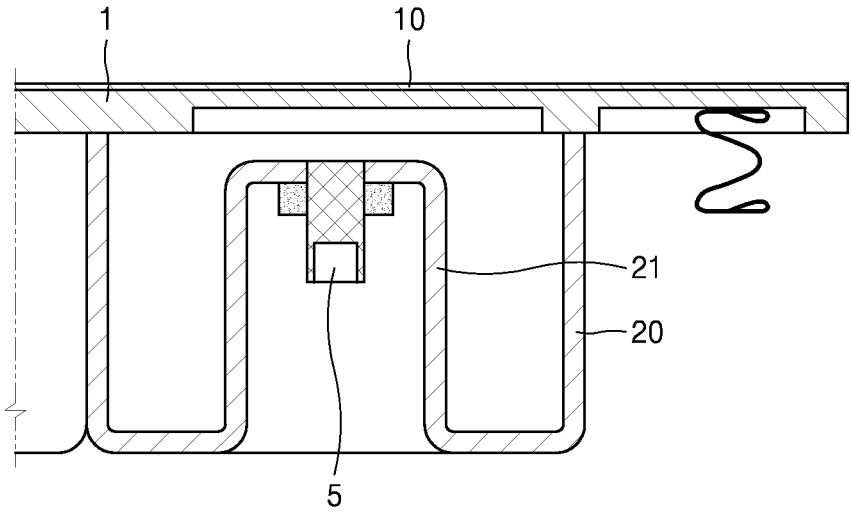
FIG. 5 is a cross-sectional view of a cavity filter, taken along a line A-A shown in FIG. 4.
Figure 6:
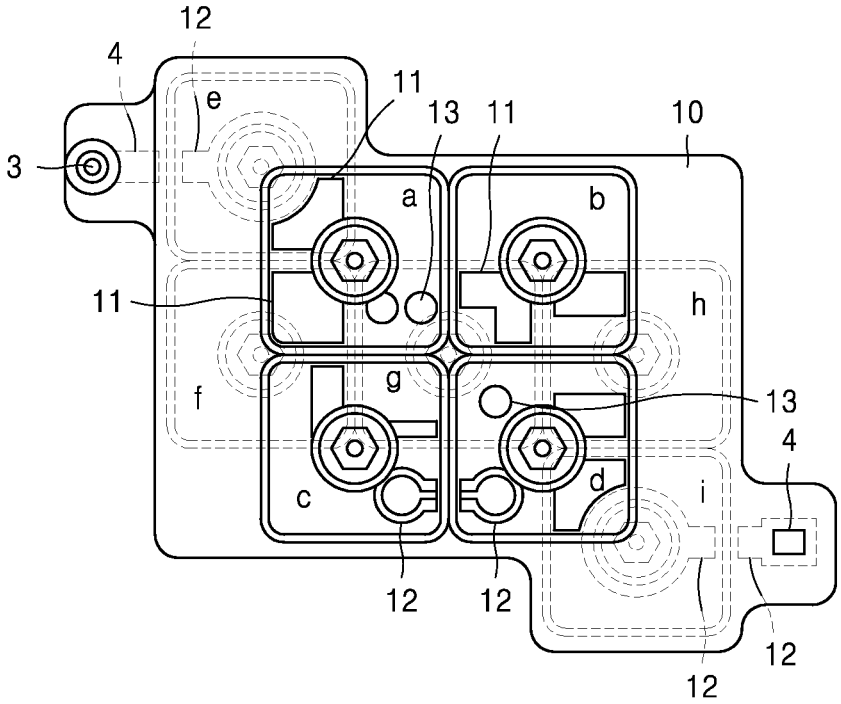
FIG. 6 is a plan view of a cavity filter shown in FIG. 3.

FIG. 3 is a perspective view of the cavity filter according to an embodiment of the present disclosure. FIG. 4 is a perspective view of a cavity filter according to another embodiment of the present disclosure. FIG. 5 is a cross-sectional view of the cavity filter, taken along a line A-A shown in FIG. 4. FIG. 6 is a plan view of the cavity filter shown in FIG. 3.

Referring to FIGS. 3 through 6, the cavity filter according to an embodiment of the present disclosure may include a printed circuit board (PCB) 1, a plurality of standard cavity modules 2, and a plurality of connectors 3. Each standard cavity module 2 included in the cavity filter may be the standard cavity module 2 shown in FIGS. 1A through 2C. However, the present disclosure is not limited to the foregoing example.

On a surface of the PCB substrate 1 may be arranged a metal layer 10 for grounding. For example, the metal layer 10 for grounding may be a copper layer achieving conduction and shielding. In a region where a part of the grounding metal layer 10 arranged on the surface of the PCB substrate 1 is removed or where the metal layer 10 for grounding is not arranged on a part of the surface of the PCB substrate 1, at least one coupling window is formed, and the PCB substrate 1 may be directly exposed in the region where the coupling window is formed. For example, the coupling window may be a solder-resist layer coupling window 11 where a solder-resist layer of the PCB substrate 1 is exposed.

The plurality of standard cavity modules 2 are fixed onto a side or both sides of the PCB substrate 1. For example, the plurality of standard cavity modules 2 may be fixed at a side or both sides of the PCB substrate 1 by soldering. An open end portion of the standard cavity module 2 is shielded by the metal layer 10 for grounding, such that the standard cavity module 2 is sealed. The plurality of standard cavity modules 2 arranged on the same surface of the PCB substrate 1 may be coupled through a micro band layer 12 provided on the PCB substrate 1. The plurality of standard cavity modules 2 arranged on different surfaces of the PCB substrate 1 may be coupled through the solder-resist coupling window 11.

The plurality of connectors 3 may include an ANT connector and a TX/RX connector that are fixed onto the PCB substrate 1 by soldering. In this case, the ANT connector and the TX/RX connector may set capacitive coupling with the standard cavity module 2 through the micro band layer 12 provided on the PCB substrate 1. However, the present disclosure is not limited to this example, and in another embodiment, a PA or TRX circuit board may be integrated as a whole into the PCB substrate 1, and a function circuit equivalent to the PA or TRX circuit may be directly connected with a micro band line. In this case, by changing a shape and a size of the micro band line, the amount of coupling may be adjusted, or may be reinforced by assembling a tap piece.

The cavity filter according to an embodiment of the present disclosure may further include an elastic sheet connection structure 4 arranged on the PCB substrate 1. For example, the elastic sheet connection structure 4 may function substantially in the same manner as the plurality of connectors 3. The elastic sheet connection structure 4 may set capacitive coupling with the standard cavity module 2 through the micro band layer 12 provided on the PCB substrate 1. According to an embodiment, for cost reduction, the elastic sheet connection structure 4 may be simply lap jointed with an external connector or main rods of another PCB substrate.

The cavity filter according to an embodiment of the present disclosure may further include an adjustment screw nut 5 that is arranged to be engaged with the screw hole 22 of the protruding column 21 so as to adjust a resonant frequency.

On both surfaces of the PCB substrate 1 to which the standard cavity module 2 is soldered, a coupling through-hole may be arranged as a sequence cavity for tuning and coupling between two standard cavity modules. To employ the above-described connection manner, a hole may be formed in the PCB substrate 1 or a solder paste, etc. may be added to the PCB substrate 1.

Since the exposed grounded metal layer 10 having a wide area on the PCB substrate 1 is grounded, the standard cavity module 2 is soldered onto a surface of the PCB substrate 1 to form a sealed cavity with the grounded metal layer 10, thereby preventing a leakage between the exposed grounded metal layer 10 having the wide area on the PCB substrate 1 and the standard cavity module 2. Moreover, an index of RF performance may be improved by integrating a resonant rod, i.e., the protruding column 21 into the cavity body 20 and forming the cavity body 20 and the protruding column 21 with the same metal material (e.g., iron or copper).

Referring back to FIGS. 3 and 4, the cavity filter according to an embodiment of the present disclosure may include the PCB substrate 1 and the plurality of standard cavity modules 2 fixed onto the both surfaces of the PCB substrate 1 by soldering. For example, standard cavity modules a, b, c, and d may be soldered to a surface of the PCB substrate 1, standard cavity modules e, f, g, and h may be soldered to the other surface of the PCB substrate 1, such that the plurality of standard cavity modules a, b, c, d, e, f, g, and h may be fixed onto the PCB substrate 1. In this case, each of the plurality of standard cavity modules a, b, c, d, e, f, g, and h may be a single standard module.

Each of the plurality of standard cavity modules 2 arranged on the same surface of the PCB substrate 1 may be coupled through the micro band layer 12 provided on a central layer of the PCB substrate 1. For example, the two adjacent standard cavity modules c and d may be coupled as sequence cavities through the central micro band layer 12. The standard cavity modules 2 that are not adjacent to each other may be cross-coupled as crossover cavities through the central micro band layer 12. For example, if the two non-adjacent standard cavity modules a and d are coupled, a micro band line formed on the central micro band layer 12 may be arranged to connect the standard cavity modules a and d.

Since a process of etching a PCB substrate may be easier than structure designing of a standard cavity module, cross coupling between non-adjacent cavities using a micro band line may be achieved easily. In addition, it is possible to overcome a limitation in cavity arrangement for cross coupling between non-adjacent cavities, which may occur in an existing die-casting filter. Thus, the flexibility of cavity filter designing may be largely improved, and a rate of utilization may be enhanced. Moreover, the amount of coupling may be adjusted by changing the shape and size of the micro band line, and the amount of coupling may be increased by assembling a tap piece.

The plurality of standard cavity modules 2 arranged on different surfaces of the PCB substrate 1 may be coupled through the solder-resist coupling window 11. In the drawings, the solder-resist coupling window 11 is marked with '*'. For example, the standard cavity module a may be coupled with the standard cavity module e arranged on the other surface through the solder-resist coupling window 11. The standard cavity module b may be coupled with the standard cavity module g arranged on the other surface through the solder-resist coupling window 11.

The plurality of standard cavity modules 2 arranged on different surfaces of the PCB substrate 1 may be coupled through a coupling through-hole 13 in the PCB substrate 1. For example, the standard cavity module a may be coupled with the standard cavity module g arranged on the other surface of the PCB substrate 1 through the coupling through-hole 13.

Figure 7:
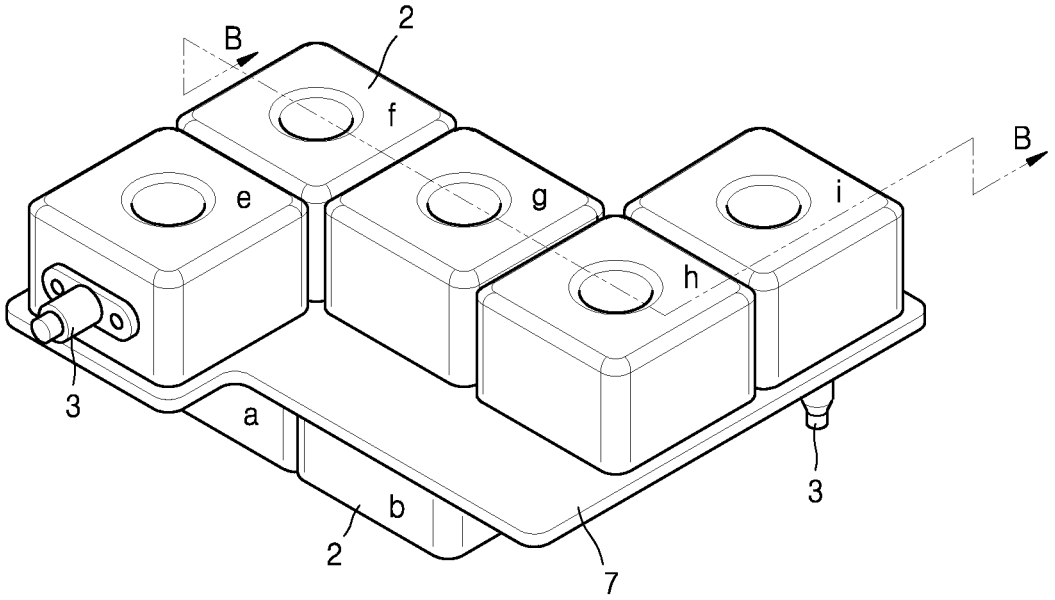
FIG. 7 is a perspective view of a cavity filter according to an embodiment of the present disclosure.
Figure 8:
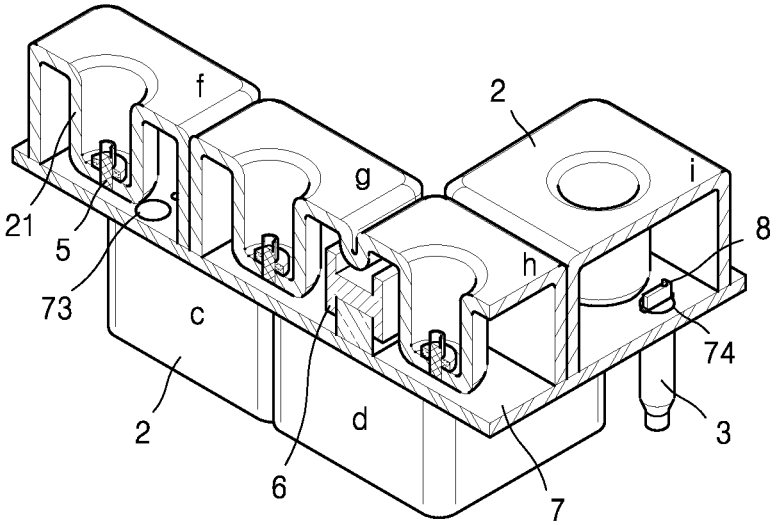
FIG. 8 is a cross-sectional view of a cavity filter, taken along a line B-B of FIG. 7.
Figure 9:
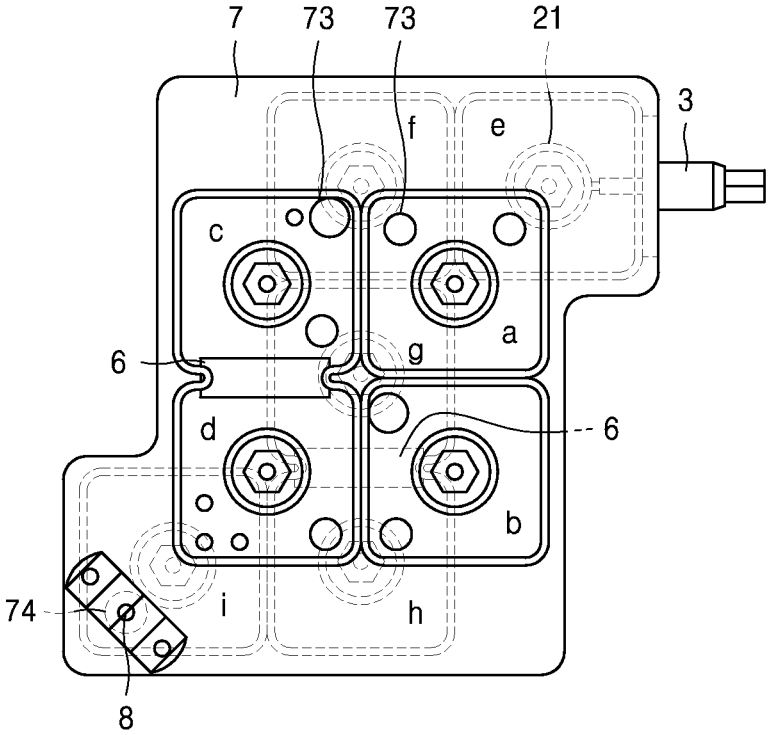
FIG. 9 is a plan view of a cavity filter shown in FIG. 7.

FIG. 7 is a perspective view of the cavity filter according to an embodiment of the present disclosure. FIG. 8 is a cross-sectional view of the cavity filter, taken along a line B-B of FIG. 7. FIG. 9 is a plan view of the cavity filter shown in FIG. 7.

Referring to FIGS. 7 through 9, the cavity filter according to an embodiment of the present disclosure may include the PCB substrate 1, the plurality of standard cavity modules 2, and the plurality of connectors 3. Each standard cavity module 2 included in the cavity filter may be, but not limited to, the standard cavity module 2 shown in FIGS. 1A through 2C. For example, the standard cavity modules c, d, g, and h may be dual-standard modules, and the other standard cavity modules a, b, e, f, and i may be mono-standard modules.

According to an embodiment, a metal layer is formed on at least both surfaces of a metal layer substrate 7, and a via-hole coupling window 73 is arranged inside. The entire metal layer substrate 7 may be formed of metal, or the metal layer may be applied onto a ceramic substrate by electroplating.

The plurality of standard cavity modules 2 are fixed onto a side or both sides of the metal layer substrate 7. For example, the plurality of standard cavity modules 2 are fixed onto a side or both sides of the metal layer substrate 7 by soldering. An open end portion of the standard cavity module 2 is shielded by the metal layer substrate 7, such that the standard cavity module 2 is sealed.

The plurality of standard cavity modules 2 arranged on different surfaces of the metal layer substrate 7 may be coupled by the via-hole coupling window 73. The via-hole coupling window 73 that satisfies size and shape requirements to form a coupling window of a sequence cavity may be arranged in a predetermined position of the metal layer substrate 7. The plurality of standard cavity modules 2 arranged on the same surface of the metal layer substrate 7 may be coupled by the coupling rod 6 or according to matching impedance between the standard cavity modules 2. In an example, the standard cavity modules c, d, g, and h formed as dual-standard modules may be coupled by the coupling rod 6. The standard cavity modules a, b, e, f, and i formed as mono-standard modules are formed through coupling impedance matching, and are cross-coupled by an impedance matching line passing through the metal layer substrate 7.

A connector hole 74 in the metal layer substrate 7 connects a tap piece 8 positioned in the cavity of the standard cavity module 2 with the connector 3. The connector 3 may include an ANT connector and a TX/RX connector. The connector 3 as shown in FIG. 9 may be directly soldered onto sidewalls of a cavity of the standard cavity module 2.

The cavity filter according to an embodiment of the present disclosure may further include an adjustment screw nut 5 that is arranged to be engaged with the screw hole 22 of the protruding column 21 so as to adjust a resonant frequency.

Detailed information and operating principles refer to a description of FIGS. 3 through 6, and a detailed description of the current embodiment will be omitted.

The standard cavity module 2 is soldered onto a surface of the metal layer substrate 7 to form a sealed cavity with the metal layer substrate 7, thereby preventing a leakage between the metal layer substrate 7 and the standard cavity module 2. Moreover, an index of RF performance may be improved by integrating a resonant rod, i.e., the protruding column 21 into the cavity body 20 and forming the cavity body 20 and the protruding column 21 with the same metal material (e.g., iron or copper).

With the cavity filter according to an embodiment of the present disclosure, by fixing the standard cavity module onto the substrate by soldering, complex die-casting for the cavity module may be avoided, thus enabling size and weight reduction of a device. Moreover, since the standard cavity modules are soldered, an additional component for fixing the standard cavity module onto the substrate is not needed, thereby achieving cost reduction.

In addition, when compared to conventional die-casting, the cavity implemented with the standard module may employ a new material and a new manufacturing cost, thereby preventing a disadvantage like display modulation caused by leakage, etc. For example, if the standard cavity module is fixed onto the substrate using soldering, it is possible to prevent a gap between the cavity and the substrate, which may be generated during fixing of the cavity onto the substrate using bolt engagement. Furthermore, the standard cavity module may be made smaller in size and have more excellent electroplating effect than a die-casting cavity. A material used for the standard cavity module is not limited to a material used for the die-casting cavity.

In an embodiment using the PCB substrate, coupling of the standard cavity modules may be achieved using wire arrangement, thereby more easily designing the cavity filter regardless of cavity topology arrangement. Since the standard cavity modules may be arranged on both surfaces of the substrate, the space utilization rate of the cavity filter may be increased.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

The invention claimed is:

1. A cavity filter comprising:

a printed circuit board (PCB) substrate comprising a micro band layer;

metal layers for grounding arranged on two surfaces of the PCB substrate, the metal layers for grounding having the micro band layer interposed therebetween;

a plurality of standard cavity modules arranged on the two surfaces of the PCB substrate, wherein each of the plurality of standard cavity modules comprises an open side surface that is fixed and sealed onto a corresponding metal layer for grounding; and a plurality of coupling windows formed by vias in the metal layers for grounding and configured to expose a solder-resist layer of the PCB substrate.

2. The cavity filter of claim 1, wherein at least one standard cavity module of the plurality of standard cavity modules is fixed onto corresponding metal layers for grounding by soldering.

3. The cavity filter of claim 2, wherein the at least one standard cavity module is a mono-standard cavity module, and the mono-standard cavity module comprises:

a cavity body which comprises an opening in an end thereof and has a pipe shape extending in a direction; and a protruding column extending from another end of the cavity body, that faces the opening of the cavity body, and comprising a screw hole in an end portion thereof.

4. The cavity filter of claim 2, wherein the at least one standard cavity module comprises a dual-standard cavity module, and wherein the dual-standard cavity module comprises:

a cavity body comprising an opening in an end thereof and a first body portion and a second body portion which have a pipe shape extending in a direction and are adhered to each other;

a first protruding column and a second protruding column extending from other ends of the first body portion and the second body portion, that face openings of the first body portion and the second body portion; and screw holes in end portions of the first protruding column and the second protruding column.

5. The cavity filter of claim 4, wherein the dual-standard cavity module further comprises a coupling rod arranged on sidewalls between the first body portion and the second body portion.

6. The cavity filter of claim 1, further comprising a plurality of coupling through-holes in the PCB substrate, that are used to couple the plurality of standard cavity modules arranged on the two surfaces of the PCB substrate.

7. The cavity filter of claim 1, further comprising a plurality of connectors which are fixed onto the PCB substrate and are capacitive-coupled with the plurality of standard cavity modules through the micro band layer.

8. A cavity filter comprising:

a metal layer substrate comprising two surfaces on which metal layers are arranged;

a plurality of standard cavity modules arranged on the two surfaces of the metal layer substrate, wherein each of the plurality of standard cavity modules comprises an open side surface that is fixed onto the metal layer substrate for sealing; and a plurality of coupling through-holes in the metal layer substrate, the plurality of coupling through-holes configured to couple the plurality of standard cavity modules arranged on different surfaces of the metal layer substrate, wherein at least one standard cavity module of the plurality of standard cavity modules comprises a mono-standard cavity module, and the mono-standard cavity module comprises:

a cavity body which comprises an opening in an end thereof and has a pipe shape extending in a direction; and a protruding column extending from another end of the cavity body, which that faces the opening of the cavity body, and comprising a screw hole in an end portion thereof.

9. The cavity filter of claim 8, further comprising a tap piece arranged inside the at least one standard cavity module of the plurality of standard cavity modules and a plurality of connectors connected with the tap piece.

10. The cavity filter of claim 8, wherein the metal layer substrate comprises the metal layer substrate electroplated on two surfaces of a ceramic substrate, or comprises only the metal layer substrate.

11. A cavity filter comprising:

a metal layer substrate comprising two surfaces on which metal layers are arranged;

a plurality of standard cavity modules arranged on the two surfaces of the metal layer substrate, wherein each of the plurality of standard cavity modules comprises an open side surface that is fixed onto the metal layer substrate for sealing; and a plurality of coupling through-holes in the metal layer substrate, the plurality of coupling through-holes configured to couple the plurality of standard cavity modules arranged on different surfaces of the metal layer substrate, wherein at least one standard cavity module of the plurality of standard cavity modules comprises a dual-standard cavity module, and the dual-standard cavity module comprises:

a cavity body which comprises an opening in an end thereof and comprises a first body portion and a second body portion which have a pipe shape extending in a direction and are adhered to each other; and a first protruding column and a second protruding column extending from other ends of the first body portion and the second body portion, which that face openings of the first body portion and the second body portion, and screw holes in end portions of the first protruding column and the second protruding column.

12. The cavity filter of claim 11, wherein the dual-standard cavity module further comprises a coupling rod arranged on sidewalls between the first body portion and the second body portion.

13. The cavity filter of claim 11, further comprising an impedance matching line passing through the metal layer substrate, wherein the impedance matching line couples a number of the plurality of standard cavity modules arranged on a same surface of the metal layer substrate.

* * * * *